United States Patent [19]

Pieck

[11] 4,062,695

[45] Dec. 13, 1977

[54] METHOD AND APPARATUS FOR TREATING SUGAR-WORKS MOLASSES

[75] Inventor: Robert Pieck, Tienen, Belgium

[73] Assignee: Raffinerie Tirlemontoise, Brussels, Belgium

[21] Appl. No.: 684,212

[22] Filed: May 7, 1976

[30] Foreign Application Priority Data

May 12, 1975 France ..... 75.14713

[51] Int. Cl.[2] ..... C13J 1/04

[52] U.S. Cl. ..... 127/9; 127/47

[58] Field of Search ..... 127/9, 47

[56] References Cited

U.S. PATENT DOCUMENTS

| | | | |
|---|---|---|---|
| 1,236,097 | 8/1917 | Monroe, Jr. | 127/47 |
| 1,850,036 | 3/1932 | Steffen, Jr. | 127/47 |
| 1,980,257 | 11/1934 | Darny | 127/47 |
| 2,016,609 | 10/1935 | Meredith et al. | 127/47 |
| 3,687,727 | 8/1972 | Vandewyer | 127/47 |
| 3,844,835 | 10/1974 | Duchateau et al. | 127/47 |
| 3,971,667 | 7/1976 | Blaude et al. | 127/47 X |

FOREIGN PATENT DOCUMENTS

| | | | |
|---|---|---|---|
| 539,290 | 6/1922 | France | 127/47 |
| 233,936 | 5/1925 | United Kingdom | 127/47 |

*Primary Examiner*—Morris O. Wolk
*Assistant Examiner*—Michael S. Marcus
*Attorney, Agent, or Firm*—Sughrue, Rothwell, Mion, Zinn and Macpeak

[57] ABSTRACT

Method and apparatus for treating sugar-works molasses wherein the third stage part of the mother liquid-hot saccharate suspension is reheated in a heat exchanger before mixing the same with the cool filtrate of the second stage to increase the temperature of the mixture to the precipitation temperature of hot saccharate.

3 Claims, 1 Drawing Figure

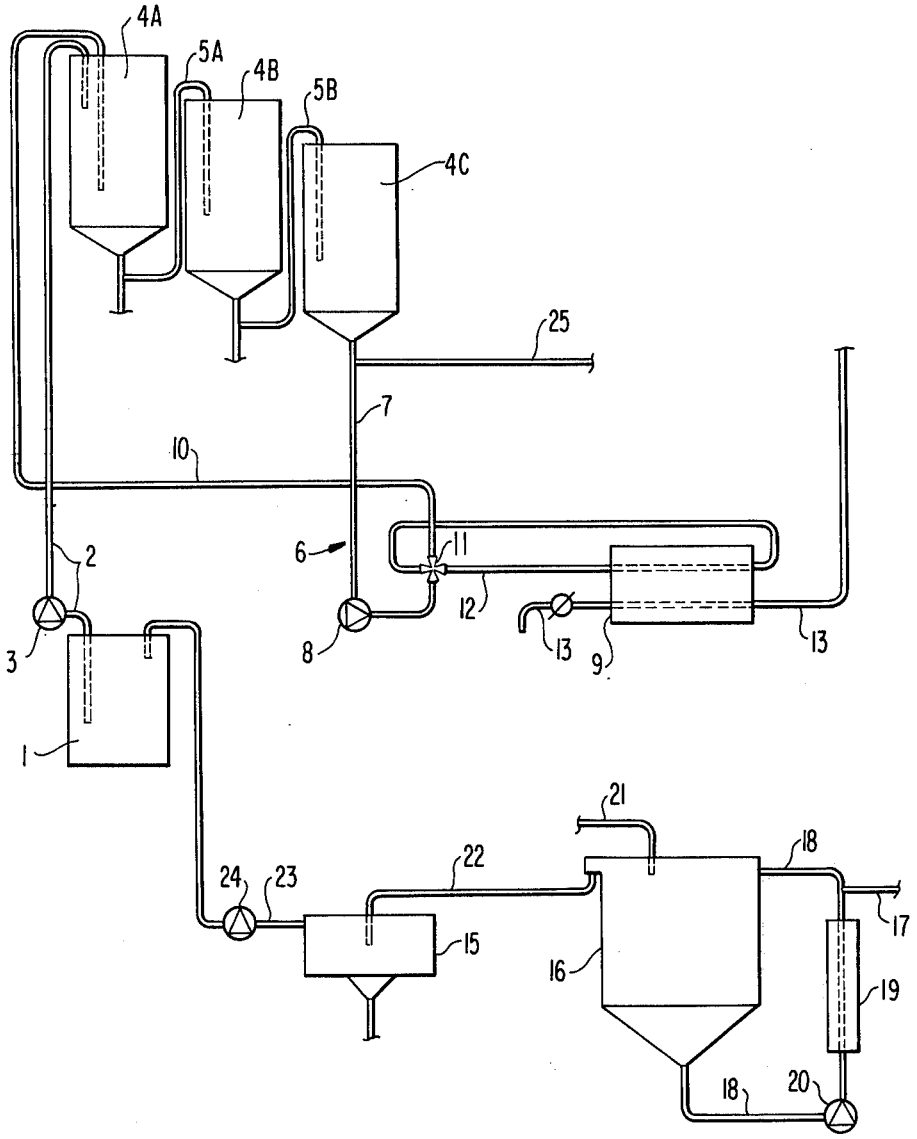
4A
5A
4B
5B
4C
25
7
10
6
11
2
12
3
8
13
9
13
1
21
18
22
24
23
17
15
16
19
18
20

METHOD AND APPARATUS FOR TREATING SUGAR-WORKS MOLASSES

This invention relates in an improvement to a method for treating sugar-works molasses. Conventionally, a first stage involves diluting the molasses with water, and a second stage involves cooling the solution and adding quicklime to precipitate an insoluble saccharose-lime combination or so-called hot saccharate, which is then separated from the mother liquor by filtering. In a third stage the heating of the cool filtrate back to the required temperature for precipitating an additional amount of insoluble saccharose-lime combination or so-called hot saccharate is required, which is then separated from the mother liquor by filtering. During the third stage, part of the mother liquor-hot saccharate suspension is cycled back to the cool filtrate.

Generally before filtering the mother liquorhot saccharate suspension, a decanting is performed. After filtering, the mother liquor is discharged as residual water. The residual water can be concentrated and used as feed for cattle.

The cool saccharate and the hot saccharate separated from the mother liquor by filtering, can be added after washing same to the raw beet juice and used as clarifying agent. Said saccharates can also be suspended into water and decomposed by carbonation to free the saccharose.

This invention relates to an improvement in the third stage of the above-described method, which stage is also called the hot-precipitating stage. This improvement relates more particularly to the heating of the cool filtrate obtained from the second stage.

Due to the encrusting properties of the insoluble saccharose-lime combination being precipitated, it is out of the question to use heat exchangers to heat the cool filtrate to the precipitation temperature of the insoluble saccharose-lime combination.

In the known installations, the heating of the cool filtrate from the temperature lower than or equal to 15° C which corresponds to the cold precipitating stage, to the hot precipitating temperature which lies from 60° to 90° C is continuously effected by direct steam injection into the cool filtrate. The most-used apparatus comprises either of an overflow cylindrical tank on the bottom of which is mounted a stirrer for insuring inner re-cycling of about 40 volumes by volume of treated cool filtrate, or of a partitioned tank inside which the heating is performed progressively and in which part of the precipitate obtained is cycled back. The recycling is deemed useful for introducing grains that help the hot precipitation.

The heating of the filtrate by injecting steam causes a dilution in the range of 10% of the treated liquid, which increases the costs of the following concentration of the residual waters. Moreover at the injection locations, there appear overheatings which result in some destruction of the already precipitated saccharose-lime combination, thus causing a loss of saccharose. To make the method more economical, use has been made of heat exchangers to heat by contact the cool filtrate up to about 40° C, that is up to a temperature at which the insoluble saccharose-lime combination does not yet precipitate, such precipitating being performed inside one of the above-described apparatus by means of further heating through steam injection. An additional drawback of the heating by steam injection lies in the steam injectors clogging in such a way that it is required to stop the process at intervals to clean the injectors.

This invention has for object to obviate the above drawbacks and notably to prevent a direct contact between steam and the cool filtrate.

For this purpose according to this invention, in the third stage, the recycled part of the mother liquor-hot saccharate suspension is heated again inside a heat exchanger before mixing same with the cool filtrate from the second stage to a temperature allowing the recycled part to bring the cool filtrate to its precipitation temperature.

Particularly according to the invention, the recycled part is reheated to a temperature from 65° to 90° C in such a way as to heat the cool filtrate to a temperature from 60° to 90° C.

Contrary to any expectation, the heat exchanger used for additional heating of the mother liquorhot saccharate suspension does not get encrusted which makes the method according to the invention usable on an industrial scale.

The amount of mother liquor-hot saccharate suspension which is reheated and used to heat the cool filtrate should be large enough on the one hand to generate in the cool filtrate enough crystalizing germs to insure obtaining a precipitate from the insoluble saccharose-lime combination with large-size grains, which are easily separated afterwards from the mother liquor, and on the other hand to insure inside the mixing container a strong enough turbulence to avoid decanting of the precipitate formed inside said container or forming preferential streams. Experience has shown that to fulfill said requirements, the amount of reheated mixture used should not be lower than 3 volumes for each volume of cool filtrate.

Other details and features of the invention will stand out from the following description given by way of non limitative example and with reference to the accompanying drawing the single FIGURE of which shows one possible type of installation for the working of the method according to the invention.

DESCRIPTION OF THE PREFERRED EMBODIMENT

The installation as shown in the drawing comprises a waiting tank 1 for the cool filtrate obtained after separating by filtering in a filter 15 the insoluble saccharose-lime combination, the so-called cool saccharate resulting from the action of powdered quicklime on diluted molasses at a temperature of about 12° C, which occurs in a reaction tank 16.

The reference numeral 17 designates the supplying pipe for the diluted molasses, which is fed continuously into a pipe 18 for recycling part of the treated molasses; said pipe 18 passes through cooling means 19 to lower the temperature of the diluted molasses and of the recycled part of the treated molasses to 15° C, and a pump 20 is provided to force the mixture into the bottom of the tank 16. Addition of lime is made through 21 with progressive contact of the lime with the introduced diluted molasses.

A volume of treated molasses flows continuously from the tank 16 and is fed through pipe 22 to the filtering apparatus 15.

From the waiting tank 1, the cool filtrate is supplied through piping 2 provided with a pump 3, to the first tank 4A of series of three mixing tanks 4A, 4B, 4C, the tanks being arranged in series by connecting the same through pipes 5A, 5B.

A recycling circuit indicated generally at 6 is provided between the last mixing tank 4C and the first mixing tank 4A. The recycling circuit comprises an outlet pipe 7 from tank 4C, a pump 8, a heat exchanger 9 and a supply pipe to tank 4A. A four-way valve 11 and piping 12 allow a reversal in the flow direction of the recycled liquid through heat exchanger 9. The heat exchanger is a surface exchanger and comprises a flow circuit 13 for the heating fluid for heating the recycled liquid from outlet pipe 7.

The installation works as follows:

Cool filtrate usually at a temperature of 15° C is pumped continuously by pump 3 from tank 1 through piping 2 into the first mixing tank 4A. Inside said first tank, the cool filtrate is heated to that temperature at which occurs the precipitation of the insoluble saccharose-lime combination, by mixing it with a proportion of the mother liquor-hot saccharate suspension which is recycled through circuit 6 and which previously has been brought to the suitable temperature inside surface heat exchanger 9. The hot mixture of mother liquor and insoluble saccharose-lime combination flows from mixing tank 4A to mixing tank 4B, then to tank 4C through the pipes 5A and 5B where the precipitation is completed. To insure good stirring and avoid decanting the precipitate inside tanks 4A, 4B, 4C, the supply to said tanks is made tangentially.

A proportion from the hot mixture of mother liquor and insoluble saccharose-lime combination is taken through the outlet duct 10 of four way valve 11 which valve is connected to duct 7. The outlet duct section 25 10 from the installation leads a portion of the mother liquor-hot saccharate mixture from tank 4C to a decanting device (not shown) the under-flow from which is then filtered together with the insoluble saccharose-lime combination obtained from the cold-precipitation stage while the upper-flow is fed to an evaporator where it is concentrated.

It has been noticed surprisingly that feeding a mixture from mother liquor and insoluble saccharoselime combination to the surface heat exchanger 9 does not cause substantial encrusting on the heat exchanger surfaces while such a phenomenom appears when working with a heat exchanger in a medium inside which occurs the precipitation of the insoluble saccharose-lime combination.

The circuit involving valve 11 and duct 12 for reversing the flow direction of the recycled liquid allows removal of small deposits which could form therein.

The amount of recycled liquid and the temperature to which said liquid is heated are dependent on the cool filtrate supply rate to tank 4A as well as on the temperature to which the cool filtrate should be brought. As a rule, the recycled suspension is heated to a temperature between 65° and 95° C so as to reheat the cool filtrate to a temperature which varies respectively from 60° to 90° C.

In the installation as shown in the drawings, the process has been worked with a flow rate of 10m³/hour of cool filtrate from tank 1 at 15° C pumped through piping 2 into the first mixing tank 4A while for such a volume, 100 m³/hour of mother liquor-hot saccharate suspension is recycled. Through outlet duct 10, there is continuously discharged 10 m³/hour of suspension to be decanted and then filtered. The heat exchanger 9 brings to 92° C the recycled mother liquor-saccharate suspension which heats in turn the cool filtrate to a temperature of about 85° C.

It must be understood that the invention is in no way limited to the above embodiments and that many changes can be brought therein without departing from the scope of the invention as defined by the appended claims.

For instance the number of mixing tanks could be lowered to one or even to a piping element; it is also possible to provide a heat exchanger between the cool filtrate storage tank ant the first mixing tank, said exchanger being of the surface type inside which the cool filtrate would undergo a pre-heating to a temperature lower than the precipitation temperature of the insoluble saccharose-lime combination.

I claim:

1. In a sugar-works-molasses treatment installation comprising:

a second stage reaction tank, means for supplying water-diluted molasses from a first stage to said second stage reaction tank, means for adding quicklime to the water-diluted molasses in said second stage reaction tank to form a water-diluted molasses quicklime solution, means for cooling said solution at said second stage reaction tank to precipitate cool saccharate therefrom, means for filtering cool saccharate from said second stage to form cool filtrate, a storage tank for holding cool filtrate means for delivering said cool filtrate from said second stage filter means to said cool filtrate storage tank, at least one mixing tank, means for supplying cool filtrate from said storage tank to said at least one mixing tank, a recycling circuit comprising an outlet pipe leading from the bottom of said at least one mixing tank and returning to that tank, said mixing tank comprising an enclosure for precipitating hot saccharate, and means for increasing the temperature of the cool filtrate to the hot saccharate precipitating temperature to effect precipitation of hot saccharate within said enclosure and to form a hot saccharate-mother liquor suspension, the improvement wherein:

said means for increasing the temperature of the cool filtrate to the hot saccharate precipitation temperature comprises at least one surface heat exchanger within said recycling circuit and in contact with the mother liquor-hot saccharate suspension being recirculated to said at least one mixing tank for increasing the temperature of recirculated mother liquor-hot saccharate suspension at said heat exchanger and in the absence of cool filtrate to a temperature sufficient to subsequently bring the cool filtrate in said enclosure to the precipitating temperature of the hot, and duct means branching from the outlet duct of said at least one mixing tank for permitting only a portion of the mother liquor-hot saccharate suspension available from said at least one mixing tank to pass through said recycling circuit;

whereby, all of the hot saccharate precipitation occurs within said at least one mixing tank remote from the surface of said surface heat exchanger.

2. In a method of treating sugar-works molasses, comprising the steps of:

cooling water-diluted molasses while adding quicklime to precipitate cool saccharate and forming a cool saccharate-mother liquor suspension, separating the cool saccharate from the mother liquor by filtering and forming a cool filtrate, and heating the cool filtrate to the required temperature for precipitating an additional amount of hot saccharate and forming a hot saccharate-mother liquor suspension, recycling a portion of the mother liquor suspension resulting from the precipitation of the hot saccharate, the improvement comprising the steps of:

reheating by a surface heat exchanger in the absence of the cool filtrate the recycled mother liquor-hot saccharate suspension prior to adding it to the cool filtrate to a temperature which will bring the cool filtrate to the precipitating temperature of the hot saccharate such that complete precipitation occurs in the area of contact between the hot mother liquor saccharate suspension and the cool filtrate to minimize the deposition of solid particles of the mother liquor-hot saccharate suspension of the surface of the heat exchanger during surface heat exchange heating of the recycled portion of the mother liquor.

3. The method as claimed in claim 2, wherein said recycled part of the mother liquor-hot saccharate suspension is reheated by said heat exchanger to a temperature from 65 to 95° C so as to heat the cool filtrate to a temperature from 60° to 90° C.

* * * * *